United States Patent [19]

Kolbeck et al.

[11] 4,076,995

[45] Feb. 28, 1978

[54] ELECTRON BEAM PRODUCING ARRANGEMENT FOR A CATHODE RAY TUBE

[75] Inventors: Rainer Kolbeck; Heinz Kuckenburg, both of Ulm (Danube); Klaus Schaffernicht, Herrlingen, all of Germany

[73] Assignee: Licentia Patent-Verwaltungs-G.m.b.H., Frankfurt am Main, Germany

[21] Appl. No.: 768,706

[22] Filed: Feb. 15, 1977

[30] Foreign Application Priority Data

Feb. 20, 1976 Germany ..... 2606897
Feb. 20, 1976 Germany ..... 50947

[51] Int. Cl.[2] ..... H01J 29/02; H01J 29/04

[52] U.S. Cl. ..... 313/446; 313/456; 313/447

[58] Field of Search ..... 313/417, 44 G, 447, 313/451, 456, 458, 441, 271 (U.S. only)

[56] References Cited

U.S. PATENT DOCUMENTS

| | | | |
|---|---|---|---|
| 2,335,818 | 11/1943 | Trumbull et al. | 313/451 X |
| 2,732,512 | 1/1956 | Briggs | 313/446 |
| 3,383,536 | 5/1968 | Moss | 313/447 |

*Primary Examiner*—Robert Segal
*Attorney, Agent, or Firm*—Spencer & Kaye

[57] ABSTRACT

An electron beam producing arrangement for a cathode ray tube comprises a vessel-shaped control electrode with an opening in its end wall for the passage of the electron beam, two substantially rectangular insulating washers abutting a cylindrical inner wall of the control electrode with opposite sides and the end wall of the control electrode with third sides, the third sides having notches thereon and a straight line cathode wire supported in the notches substantially parallel to the end wall and below the opening therein.

23 Claims, 4 Drawing Figures

ELECTRON BEAM PRODUCING ARRANGEMENT FOR A CATHODE RAY TUBE

BACKGROUND OF THE INVENTION

The present invention relates to an electron beam producing arrangement for a cathode ray tube having a vessel-shaped control electrode in the front wall of which is arranged an opening for the passage of the electron beam and having a cathode comprising a straight line cathode wire which is mounted inside the cavity of the control electrode such that the cathode wire runs substantially parallel to the inner surface of the end wall of the control electrode and below the opening for the passage of the beam.

An arrangement for producing an electron beam of the type stated above is already known from German Auslegeschrift No. 12 79 215. In this known cathode arrangement, it is necessary for a heated wire to be used which has sufficient strength. This in turn determines increased heat output for the purpose of heating the cathode wire as a result of the fairly large thickness of the cathode wire.

SUMMARY OF THE INVENTION

It is an object of the invention to provide a new type of arrangement for producing an electron beam to heat up the cathode with an extremely low heat output and which may be controlled well with respect to its construction even with a high degree of accuracy.

According to the invention, there is provided an electron beam producing arrangement comprising a vessel-shaped control electrode, an end wall for said vessel-shaped control electrode defining an opening for passage of the electron beam, a cylindrical inner surface for said vessel-shaped control electrode and surrounding said end wall, two substantially rectangular insulating washers within said vessel-shaped control electrode abutting said cylindrical inner wall with opposite sides thereof, abutting said end wall with third sides thereof and defining notches in said third end walls and a straight line cathode wire supported in said notches substantially parallel to said end wall below said opening in said end wall.

Further according to the invention, there is provided an electron beam producing arrangement for a cathode ray tube having a vessel-shaped control electrode, in the end wall of which is arranged an opening for the passage of the electron beam and with a cathode comprising a straight line cathode wire which is mounted inside the cavity of the control electrode such that the cathode wire runs substantially parallel to the inner surface of the end wall of the control electrode and runs below the opening for the passage of the beam, characterized in that in order to mount the cathode wire two substantially rectangular mica washers are provided which are connected together by means of spacing members in a parallel position, said mica washers being inserted into the cavity of said control electrode; that each said mica washer abuts the cylindrical inner surface of said control electrode with two opposite side edges and abuts the inner surface of the end wall of said control electrode with a third side edge and that each of said two side edges, abutting the end wall, has a notch for accommodating a cathode wire, the depth of said notch is dimensioned so that said cathode wire tensioned in the two notches has a desired spacing from the inner surface of said end wall of said control electrode.

BRIEF DESCRIPTION OF THE DRAWINGS

The invention will now be described in greater detail, by way of example, with reference to the drawings, in which.

DESCRIPTION OF THE PREFERRED EMBODIMENTS

Figure 1:
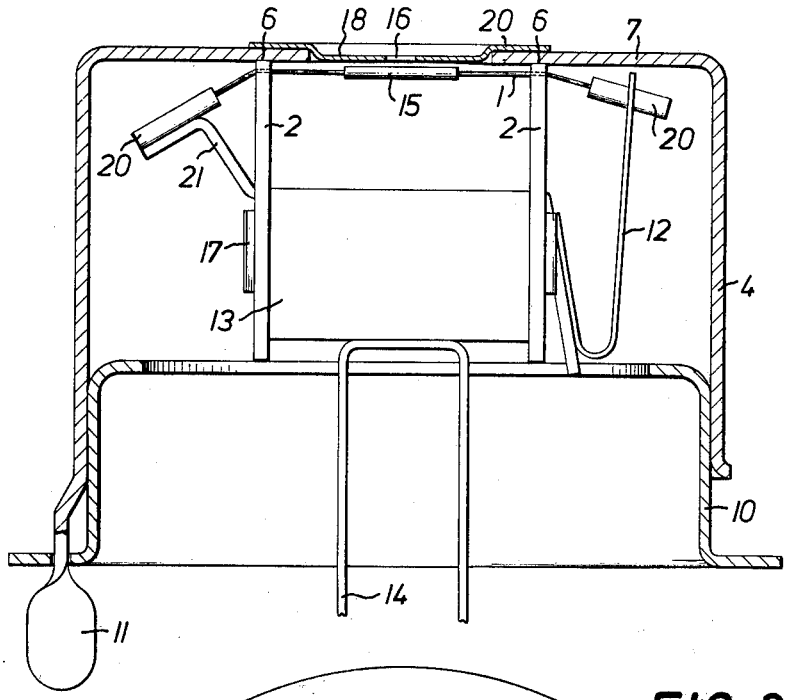
FIG. 1 is a sectional elevational view of an arrangement in accordance with the invention.
Figure 2:
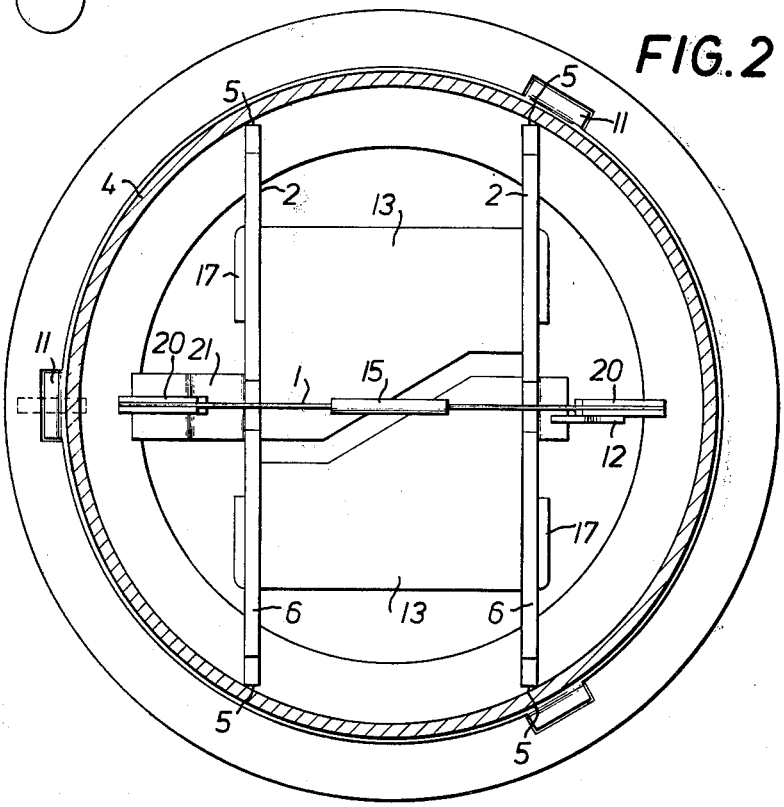
FIG. 2 is a plan view of the arrangement shown in FIG. 1 but with the end wall of the control electrode omitted for clarity.

In a preferred embodiment of the invention it is proposed, for the purpose of mounting the cathode wire 1 in a vessel-shaped control electrode 4, to provide two substantially rectangular mica washers 2, which are connected together (in a parallel position) by means of distance pieces and are inserted into the cavity of the control electrode 4 such that each mica washer 2 abuts the cylindrical inner surface of the control electrode 4 with two of its opposite side edges 5 and, with a third side edge 6, abuts the inner surface of the end wall 7 of the control electrode and that each of the two side edges 7 abutting the end wall have a notch 8 for accommodating the cathode wire 1, the depth of which notch should be dimensioned so that the cathode wire 1, tensioned in the two notches has a desired spacing from the inner surface of the end wall 7 of the control electrode.

A substantial advantage of the described arrangement for producing a beam lies in the extremely small heat output which is required to heat the cathode. Heat outputs can be achieved which are smaller than 50 milliwatts. A further advantage of the system described lies in simple and economical manufacture. It is possible to use substantially punched and stamped parts which may be mass-produced with a large degree of accuracy. Moreover, the described construction permits the use of a very small number of different parts as several parts are used in pairs and are identical. Furthermore, it has been proved that the described construction also permits a very high degree of accuracy with the smallest spacings and in mass production.

FIG. 1 shows the construction of the described electron beam producing arrangement in cross-section, the system having the vessel-shaped control electrode 4 and the cathode wire 1, which latter is located at a small distance below an opening in the end surface 7 of the control electrode 4 which allows the passage of electrons. Two substantially rectangular mica washers 2 form a cage together with distance pieces 13, the cathode wire 1 being fixed to the cage so that it comes to lie in the desired position with respect to the opening 16 for the passage of the beam. The lateral setting of position of the mica washers 2 takes place because the mica washers abut the inner wall of the cylindrical part of the control electrode 4 with their side edges 5. The adjustment of the position may be undertaken very precisely in this way as mica washers may be punched relatively exactly. They may be manufactured with a very small amount of excess so that they abut with their edges 5 in a slightly resilient manner and this is facilitated because of the resilient properties of the mica washers.

Location of the cage formed from the mica washers 2 and the distance pieces 13 takes place in a direction axially of the tube inside the cavity of the control electrode 4 in this way: the mica washers are pressed with their edges 6 against the inner end surface of the end wall 7 of the control electrode 4 by means of a pressure ring 10. For example, as shown the pressure ring 10 may have a zig-zag profile. It is advisable if slits are arranged in the outer bent edge of this pressure ring 10 through which tongues 11 of the control electrode 4 project. As a result of twisting these tongues 11, (it is preferable if three of these are distributed over the circumference), pressure is exerted on the pressure ring and thus a pressure is also exerted on the mica washers 2 so that the edges 6 abut the end wall 7 under pressure. This pressure ring is only shown in FIG. 1 and is omitted in the subsequent Figures as its construction and functioning are clearly visible from FIG. 1. The distance pieces 13 preferably comprise U-shaped bent parts having tongues 17 which project through appropriate slits in the mica washers 2 and are bent around them, so that the mica washers 2 form an inherently rigid cage together with the distance pieces 13. The distance pieces 13 are preferably of the same type and are used in pairs and arranged insulated from each other so that they are able to carry fixing members 21 or 12 at the same time for the purpose of mounting the cathode wire 1. Similarly input leads 14 are arranged on these spacing members 13, these being connected electrically to the base connections of the tubes.

Figure 3:
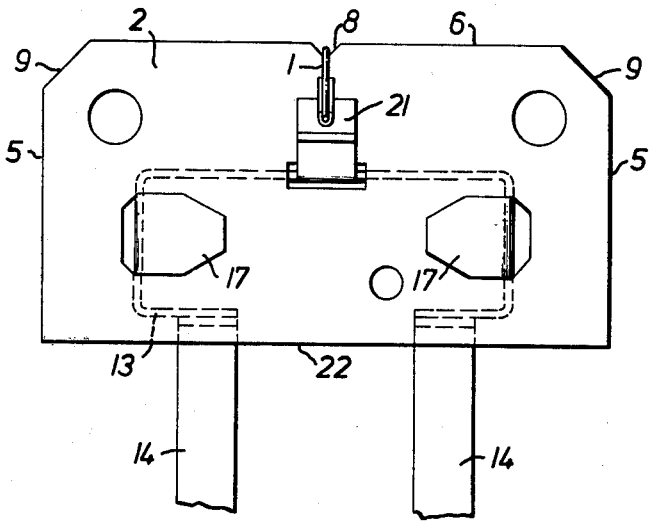
FIG. 3 is a side view of one of the mica washers used in the arrangement shown in FIGS. 1 and 2, also showing ancillary apparatus.

In a preferred embodiment of the mica washers 2, the corners 9 which limit the side edge 6 which abuts the end wall 7, are slanted as may be seen from FIG. 3. Thus it is ensured that the side edges 6 of the mica washers 2 firmly abut the end wall 7 of the control electrode 4 which on the other hand could be restricted by the construction of the control vessel in the junction between the cylindrical part and the end wall. The pressure ring 10 exercises its pressure on the side edge 22. The fixing of the position of the cathode wire 1 takes place preferably by means of a notch 8 respectively in the side edges 6 of the mica washer 2, wherein it is particularly advisable if these notches are constructed in a wedge shape as may be seen from FIGS. 3 and 4. As a result of the position of the notches 8 and the depth of the notches 8, an exact spacing of the cathode wire 1 with respect to the edge 6 and thus with respect to the inner surface of the end wall 7 may be set simply, if the cathode wire 1 is tensioned by means of these two notches as may be seen from FIG. 1. In order to ensure safe abutment of the cathode wire 1 in the base of the notch of notches 8 the ends of the cathode wire 3 extending laterally beyond the mica washers 2 are preferably mounted in such a manner that they are angled in a direction away from the end wall 7. The tensioning of the cathode wire 1 is effected at least on one side by means of a U-shaped bent spring 12. In the embodiment shown, the other end of the cathode wire is fixed to a tongue 21 which forms a part of a spacing piece 13. In some cases it may also be advisable to arrange tensioning springs on both sides. The tensioning spring 12 is fixed to a bent tongue 17 of the other spacing part 13. Fastening takes place preferably by means of welding. As the cathode wire is constructed so as to be very thin in order to achieve a very small heat output it is advisable, as shown in the Figures, to strengthen the ends of the cathode wire by pressing on collars or U-shaped parts 20. On the other hand there would be the danger that the thin cathode wire 1 might be so greatly damaged in its cross-section during welding to the mountings that failure of the cathode is to be feared.

In the shown embodiment, the cathode wire 1 is covered with an emission layer 15 in its region below the opening 16 for the passage of electrons. This emission layer may be applied relatively simply in an exact thickness. The strength of this emission layer must be taken into consideration when fixing the position of the cathode wire 1, i.e., particularly the depth of the notches 8 in the mica washers 2.

Figure 4:
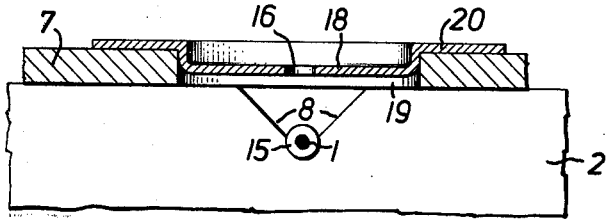
FIG. 4 is a fragmentary sectional view showing one form of construction of the electron beam aperture and the arrangement of the cathode wire therebeneath.

In a further preferred embodiment, a thinned part of the end wall 7 of the control electrode 4 is provided in the region of the opening 16 for the passage of electrons. As a result the heat output is reduced still further inasmuch as the electron-optical relationships may be made more favourable. A particularly advisable construction of the end wall of the control electrode 4 lies in applying a circular opening into the end wall concentric to the axis of the electron beam, said opening being substantially larger than the required opening 16 for the passage of electrons. In FIG. 4 this circular opening is designated 19. This circular opening is now covered by a foil 18 in accordance with a modification of the invention, its thickness being substantially smaller than the thickness of the end wall 7. The opening 16 for the passage of electrons is arranged in this foil concentric to the axis of the electron beam. The foil is preferably stamped in hat-shape as may be seen from FIGS. 1 and 4. The cylindrical part of this stamped foil 18 should fit as accurately as possible into the opening 19. The edge 20 of this stamped foil 18 preferably lies on the outer surface of the end wall 7 and is fixed thereto by means of a spot weld connection.

In a preferred embodiment, the cathode wire had a diameter of approximately 0.03 mm and had a diameter of approximately 0.09 mm in the region provided with the emission layer 15. The opening 16 for the passage of electrons had a diameter of approximately 0.3 mm. The circular opening 19 had a diameter of approximately 3 mm, i.e., it was approximately ten times as large as the opening 16 for the passage of the beam. The foil from which the hat-shaped bowl 18 was stamped had a thickness of approximately 0.05 mm. The surface of the emission layer 15 of the cathode wire 1 had a spacing of approximately 0.25 mm from the opening 16 for the passage of electrons. This type of cathode arrangement could be operated by a heat output of approximately 35m watts when there is sufficient intensity of the beam current, wherein the maximum anode voltage was approximately 2kV. In a further embodiment, the tensioning spring 12 for tensioning the cathode wire 1 was constructed as a wound spring, i.e., instead of the simple hairpin bend some helical turns were provided.

It will be understood that the above description of the present invention is susceptible to various modification changes and adaptations.

What is claimed is:

1. An electron beam producing arrangement for a cathode ray tube having a vessel-shaped control electrode, in the end wall of which is arranged an opening for the passage of the electron beam and with a cathode comprising a straight line cathode wire which is mounted inside the cavity of the control electrode such that the cathode wire runs substantially parallel to the inner surface of the end wall of the control electrode and runs below the opening for the passage of the beam, characterized in that in order to mount the cathode wire two substantially rectangular mica washers are provided which are connected together by means of spacing members in a parallel position, said mica washers being inserted into the cavity of said control electrode; that each said mica washer abuts the cylindrical inner surface of said control electrode with two opposite side edges and abuts the inner surface of the end wall of said control electrode with a third side edge and that each of said two side edges, abutting the end wall, has a notch for accommodating a cathode wire, the depth of said notch is dimensioned so that said cathode wire tensioned in the two notches has a desired spacing from the inner surface of said end wall of said control electrode.

2. An arrangement as defined in claim 1, and comprising slanted edges for the corners of said mica washers limiting the side edges abutting said end wall.

3. An arrangement as defined in claim 1 and comprising a pressure ring inserted into the cavity of said control electrode to press said mica washers against said end wall of said control electrode.

4. An arrangement as defined in claim 3, and comprising twisted tongue connections for pressing said pressure ring.

5. An arrangement as defined in claim 1 and comprising a tensioned spring fixed to said cathode wire at one end.

6. An arrangement as defined in claim 1, wherein said cathode wire is mounted at an angle at its ends such that it is drawn as a result of its tensioned state into the notch base of said notches of said mica washers.

7. An arrangement as defined in claim 1 and comprising two electrically insulated spacing members for connecting said mica washers with each said spacing member having devices for fixing the ends of said cathode wire and current supply lines.

8. An arrangement as defined in claim 1 and comprising an emission layer covering said cathode wire at least in the region of the opening for the passage of electrons.

9. An arrangement as defined in claim 7, wherein said spacing members for the connection of said mica washers comprise stamped parts made of sheet metal connected to said mica washers by means of tongue connections.

10. An arrangement as defined in claim 1 and comprising a thin metal foil, defining said opening for the passage of electrons, inserted into an opening in said end wall of said control electrode substantially larger than said opening for the passage of electrons.

11. An arrangement as defined in claim 10, wherein said metal foil is stamped in hat shape.

12. An arrangement as defined in claim 11, wherein the edge of said hat-shaped stamped metal foil is fixed to the outer surface of said end wall of said control electrode.

13. An arrangement as defined in claim 12, wherein said fixing comprises spot welding.

14. An arrangement as defined in claim 10, wherein said metal foil has a thickness smaller than 0.2 mm.

15. An arrangement as defined in claim 10, wherein said metal foil has a thickness between 0.2 mm and 0.1 mm.

16. An arrangement as defined in claim 10, wherein said opening in said end wall of said control electrode is between six and twenty times larger than said opening for the passage of electrons in said metal foil.

17. An arrangement as defined in claim 10, wherein said opening is said end wall of said control electrode is between eight and fifteen times larger than said opening for the passage of electrons in said metal foil.

18. An arrangement as defined in claim 1, wherein said two mica washers comprise substantially the same stamped members.

19. An arrangement as defined in claim 7, wherein said spacing members comprise substantially the same stamped members.

20. An arrangement as defined in claim 1, wherein said notches in said mica washers are constructed in wedge shape.

21. An arrangement as defined in claim 5, wherein said tensioning spring is constructed in the shape of a hairpin.

22. An arrangement as defined in claim 5, wherein said tensioning spring is constructed as a wound spring.

23. An electron beam producing arrangement comprising a vessel-shaped control electrode, an end wall for said vessel-shaped control electrode defining an opening for passage of the electron beam, a cylindrical inner surface for said vessel-shaped control electrode and surrounding said end wall, two substantially rectangular insulating washers within said vessel-shaped control electrode abutting said cylindrical inner wall with opposite sides thereof, abutting said end wall with third sides thereof and defining notches in said third end walls and a straight line cathode wire supported in said notches substantially parallel to said end wall below said opening in said end wall.

* * * * *